US006280795B1

(12) United States Patent
Zervoudis et al.

(10) Patent No.: US 6,280,795 B1
(45) Date of Patent: Aug. 28, 2001

(54) GALVANIZING OF REACTIVE STEELS

(75) Inventors: John Zervoudis, Kilbride; Gary R. Adams, Burlington; Victor M. Duarte, Hamilton, all of (CA); Michael Gilles, Geel (BE); Richard Sokolowski, Raches (FR)

(73) Assignee: Cominco, Ltd., Vancouver (CA)

( * ) Notice: Subject to any disclaimer, the term of this patent is extended or adjusted under 35 U.S.C. 154(b) by 0 days.

(21) Appl. No.: 09/445,144

(22) PCT Filed: May 22, 1998

(86) PCT No.: PCT/CA98/00506

§ 371 Date: Feb. 22, 2000

§ 102(e) Date: Feb. 22, 2000

(87) PCT Pub. No.: WO98/55664

PCT Pub. Date: Dec. 10, 1998

(51) Int. Cl.[7] ..... B05D 1/18; C22C 18/00; C22C 18/04

(52) U.S. Cl. ..... 427/433; 427/436; 420/514; 420/517; 420/518; 420/524

(58) Field of Search ..... 427/433, 436; 420/514, 517, 518, 522, 524

(56) References Cited

U.S. PATENT DOCUMENTS 4,238,532 12/1980 Dreulle .
5,445,791 * 8/1995 Gagne ..... 420/514

FOREIGN PATENT DOCUMENTS

882256 * 7/1980 (BE) .
2 366 376 10/1976 (FR) .
3-170646 * 7/1991 (JP) .
7-153449 6/1995 (JP) .
7-278707 * 10/1995 (JP) .

OTHER PUBLICATIONS

International Search Report for PCT/CA98/00506, Sep. 1998.

* cited by examiner

*Primary Examiner*—Shrive P. Beck
*Assistant Examiner*—Michael Barr
(74) *Attorney, Agent, or Firm*—Jaeckle Fleischmann & Mugel, LLP

(57) ABSTRACT

An alloy for galvanizing steel comprises, by weight, aluminum in the amount of at least 0.001% to 0.007%, preferably 0.002 to 0.004%, tin in the amount of at least 0.5% to a maximum of 2%, preferably at least 0.8%, and one of an element selected from the group consisting of vanadium in the amount of at least 0.02%, preferably 0.05% to 0.12%, titanium in the amount of at least 0.03%, preferably 0.06% to 0.10%, and both vanadium and titanium together in the amount of at least 0.02% vanadium and at least 0.01% titanium for a total of at least 0.03%, preferably 0.05% to 0.15%, the balance zinc containing up to 1.3 wt. % lead. In another embodiment, the alloy comprises, by weight, aluminum in the amount of at least 0.001%, tin in the amount of 0.5% to 2%, and vanadium and nickel together in the amount of at least 0.02% vanadium and at least 0.02% nickel to a maximum of 0.15% vanadium and nickel collectively. Titanium may be added in an amount, by weight, of at least 0.01% titanium to a collective maximum of 0.2% vanadium, nickel and titanium. In a further embodiment, the alloy comprises, by weight, aluminum in the amount of at least 0.001%, tin in the amount of about 0.5% to about 2%, vanadium in the amount of 0.02 to 0.12%, and bismuth in the amount of 0.05% to 0.1%, the balance zinc containing up to 1.3 wt. % lead.

18 Claims, 2 Drawing Sheets

GALVANIZING OF REACTIVE STEELS

CROSS-REFERENCE TO RELATED APPLICATION

This application claims priority from U.S. application Ser. No. 08/870,164, filed Jun. 6, 1997 now abandoned, for GALVANIZING OF REACTIVE STEELS, the disclosure of which is incorporated herein by reference.

BACKGROUND OF THE INVENTION

1. Field of the Invention

This invention relates to a galvanizing alloy and process and, more particularly, relates to a galvanizing alloy and an immersion galvanization process adapted to control the undesirable effects associated with galvanizing reactive steels.

2. Description of the Related Art

The conventional process for hot dip galvanizing of low carbon steels comprises pretreatment of said steels in a 20% to 30%, by weight, zinc-ammonium-chloride ($ZnNH_4Cl$) pre-flux, followed by immersion in molten zinc or zinc alloy baths. The 'normal' or 'N' coating structure produced on low reactivity steel by conventional hot dip galvanizing processes has well defined, compact alloy intermetallic layers. The predominant growth mode in this type of coating is by solid-state diffusion of iron and zinc, and thus well established intermetallic delta and zeta layers control the rate of the galvanizing reaction. The diffusion reaction rate decreases as the coating thickness increases, thus permitting predictable, consistent coverage. The normal coating has a bright metallic luster.

Recent developments in the manufacture of low-alloy high-strength steels include continuous casting. In the continuous casting process, it is necessary to add elements that 'kill' or deoxidize the steel, i.e., prevent gaseous products that produce porosity. Silicon is commonly employed for this purpose. The resulting steels generally contain between 0.01% to 0.3%, by weight, silicon but may include up to or more than about 0.5 wt % silicon and are known as 'reactive steels' or silicon steels.

Phosphorus in the steel also affects reactivity, having an accepted measure of reactivity that is approximately 2.5 times that of silicon. Thus, the silicon content plus 2.5 times the phosphorus content is known as the effective silicon content of the steel.

Silicon steels that have high high reactivity pose problems to the galvanizing process, producing thick, brittle and uneven coatings, poor adherence and/or a dull or marbled appearance. These coatings are known as 'reactive' coatings. The high reactivity of the silicon steels also causes excessive zinc consumption and excessive dross formation.

Silicon released from the steel during galvanizing is insoluble in the zeta layer, which creates an instability in that layer and produces thick, porous intermetallic layers. The microstructure is characterized by a very thin and uneven delta layer overlaid by a very thick and porous zeta layer that allows liquid bath metal to react near the steel interface during the entire immersion period. The result is a linear growth mode with immersion time that allows the formation of excessively thick coatings. These undesirably thick coatings are generally very rough, brittle, and dull in appearance.

Steels with silicon levels between 0.05 to 0.15 (i.e. around the "Sandelin Peak" area). may also develop a 'mixed' reactivity or 'M' coating, which is characterized by a combination of reactive and non-reactive areas on the same steel that is believed to be the result of differences in localized silicon levels on the surface of the steel.

It is known in the prior art to control reactivity by producing bath temperature and immersion time at a rate inversely proportional to the silicon content of the steel. Lower bath temperatures, on the order of 430° C., and reduced immersion times tend to control the reactivity of high silicon steels. However, using low bath temperatures and reduced times on low silicon steels produces unacceptably thin coating thicknesses. Thus, the galvanizer must know the silicon content of the steel beforehand and adjust the hot dip parameters accordingly. This approach cannot be implemented if steel reactivity is not known or if components to be galvanized comprise parts of different reactivities welded together. With low-temperature galvanizing, productivity can be poor because of the need to increase immersion times.

It is also known to control steel reactivity by adding alloy elements to the zinc galvanizing bath. One such addition is nickel in a process known as the Technigalva™ (or Nickel-Zinc) process A nickel content of 0.05 to 0.10% by weight in the zinc bath effectively controls reactive steels having up to about 0.2% by weight silicon content. For steels having silicon levels above approximately 0.2 wt. %, this nickel-zinc process is not effective and thus it is only a partial solution to the reactive steel galvanizing problem. Normal steels of low reactivity, when galvanized by the nickel-zinc process, pose the same difficulty as seen in low temperature galvanizing in that coating thickness may be unacceptably thin. With this process, it is thus preferred that the galvanizer know the reactivity of the steel beforehand and adjust galvanizing conditions accordingly, both of which are difficult to accomplish in practice. Under some conditions, this process also produces dross that tends to float in the bath and be drawn out on the workpiece, producing unacceptable coatings.

Another alloy used to control reactivity is that disclosed in French Patent No. 2,366,376, granted Oct. 27, 1980, for galvanizing reactive steels, known as the Polygalva™ process. The alloy comprises zinc of commercial purity containing, by weight, 0.1 to 1.5% lead, 0.01 to 0.05% aluminum, 0.03 to 2.0% tin, and 0.001 to 2.0% magnesium.

U.S. Pat. No. 4,439,397, granted Mar. 27, 1994, discusses the accelerated rate at which the magnesium and aluminum are consumed or lost in this Polygalva™ process for galvanizing steel. Procedures are presented to overcome the inherent difficulty in replenishing deficient aluminum or magnesium in the zinc alloy galvanizing bath. The process has serious limitations in that the steel has to be meticulously degreased, pickled, pre-fluxed, and oven-dried to obtain good quality product free of bare spots. Thus, in most cases, new high-quality installations are usually required.

U.S. Pat. No. 4,168,972, issued Sep. 25, 1979, and U.S. Pat. No. 4,238,532, issued Dec. 9, 1980, also disclose alloys for galvanizing reactive steels. The alloys presented include variations of the Polygalva™ alloy components of lead, aluminum, magnesium, and tin in zinc.

It is known in the prior art that aluminum included in the galvanizing bath reduces the reactivity of the high silicon steels. A process known as the Supergalva™ process includes an alloy of zinc containing 5 wt. % aluminum and requires a special flux and double dipping not generally accepted by commercial galvanizers.

Co-pending U.S. patent application Ser. No. 08/667,830 filed Jun. 20, 1996 now abandoned, the disclosure of which is incorporated herein by reference, describes a new alloy and process for controlling reactivity in steels with silicon content up to 1 wt. %. The alloy comprises zinc of commercial purity containing, by weight, one or both of vanadium in the amounts of at least 0.02% to 0.04% and titanium in the amounts of at least 0.02% to 0.05%.

It is a principal object of the present invention to provide a process and alloy to effectively control reactivity on a full range of steels, including low and high silicon steels. The process should also produce coatings of acceptable and uniform thickness over the full range of steels.

Another object of the invention is to provide an alloy and process that uses standard galvanizing equipment operated under normal conditions for galvanizing steels of mixed reactivity without the need to adjust for variations in steel chemistry.

SUMMARY OF THE INVENTION

The disadvantages of the prior art may be substantially overcome by providing a new galvanizing process and alloy that can be readily adapted to standard hot-dip galvanizing equipment.

The process of the present invention for galvanizing steel. including reactive steels, comprises immersing the steel in a molten bath of a zinc alloy comprising, by weight, aluminum in the amount of at least 0.001% to 0.007%, preferably 0.002% to 0.004%, tin in the amount of at least 0.5% to a maximum of 2%, preferably at least 0.8%, and one of an element selected from the group consisting of vanadium in the amount of at least 0.02%, preferably 0.05% to 0.12%, titanium in the amount of at least 0.03%, preferably 0.06% to 0.10%, and both vanadium and titanium together in the amount of at least 0.02% vanadium and at least 0.01% titanium for a total of at least 0.03%, preferably 0.05% to 0.15%, the balance zinc containing up to 1.3 wt. % lead.

Also in accordance with the present invention is an alloy for galvanizing steel that comprises, by weight, aluminum in the amount of at least 0.001% to 0.007%, preferably 0.002 to 0.004%, tin in the amount of at least 0.5% to a maximum of 2%, preferably at least 0.8%, and one of an element selected from the group consisting of vanadium in the amount of at least 0.02%, preferably 0.05% to 0.12%, titanium in the amount of at least 0.03%, preferably 0.06% to 0.10%, and both vanadium and titanium together in the amount of at least 0.02% vanadium and at least 0.01% titanium for a total of at least 0.03%, preferably 0.05% to 0.15%, the balance zinc containing up to 1.3 wt. % lead.

In another embodiment of the invention, the alloy comprises, by weight, aluminum in the amount of at least 0.001%, tin in the amount of 0.5% to 2%, and vanadium and nickel together in the amount of at least 0.02% vanadium and at least 0.02% nickel to a maximum of 0.15% vanadium and nickel collectively. Titanium may be added in an amount, by weight, of at least 0.01% titanium to a collective maximum of 0.2% vanadium, nickel and titanium. In a further embodiment of the invention, the alloy comprises aluminum in the amount, by weight, of at least 0.001%, tin in the amount of about 0.5% to about 2%, vanadium in the amount of 0.02 to 0.12%, and bismuth in the amount of 0.05% to 0.1%, the balance zinc containing up to 1.3 wt. % lead.

BRIEF DESCRIPTION OF THE DRAWINGS

The process of the invention and the alloy produced thereby will now be described with reference to the following drawings.

DESCRIPTION OF THE PREFERRED EMBODIMENTS

Figure 1:
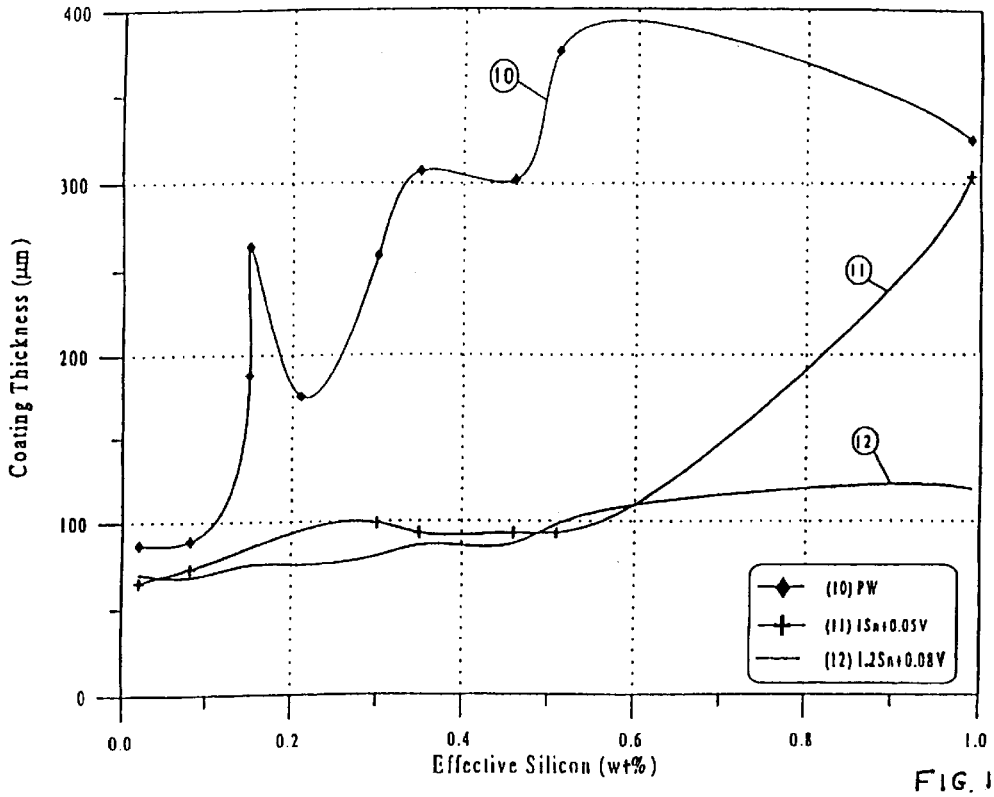
FIGS. 1–3 are graphs illustrating galvanized coating thickness of a variety of galvanizing coatings on steel surfaces having a silicon content ranging from 0 to 1.0 wt. % under conditions of eight-minute immersion at 450° C., FIG. 1 being a graph showing average coating thickness versus silicon content in a galvanizing bath of Prime Wegtern (PW) zinc with tin and vanadium, FIG. 2 being a graph showing average coating thickness versus silicon content in a galvanizing bath of PW zinc with tin and titanium, and FIG. 3 being a graph showing average coating thickness versus silicon content in a galvanizing bath of PW zinc with tin and both vanadium and titanium together.
Figure 2:
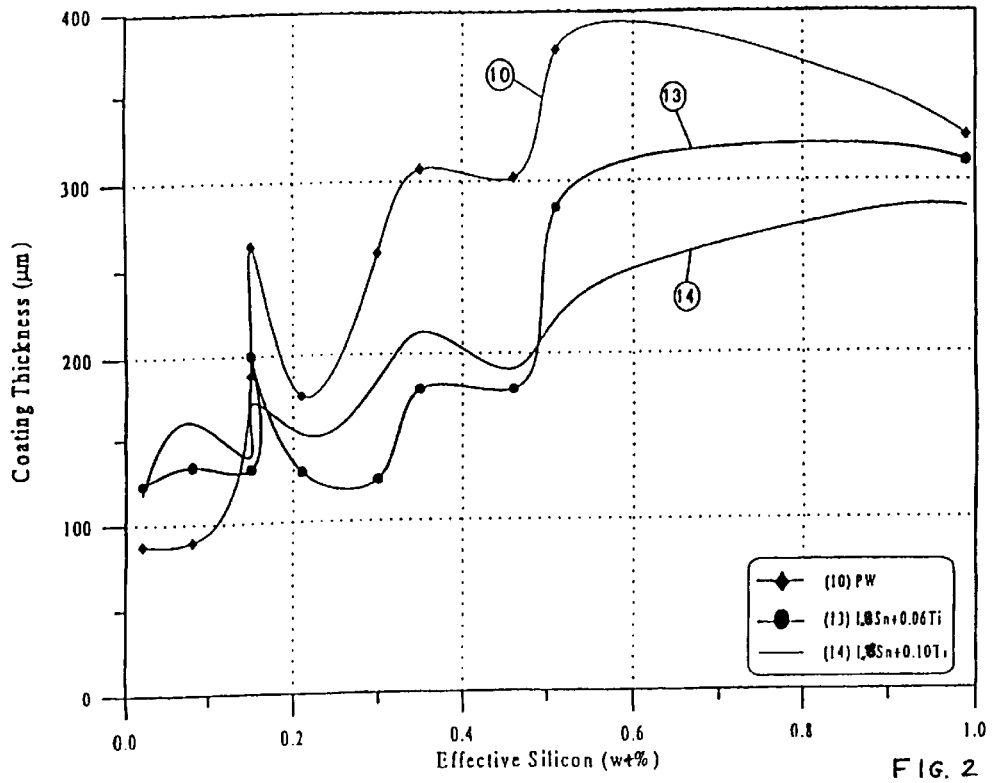
Figure 3:
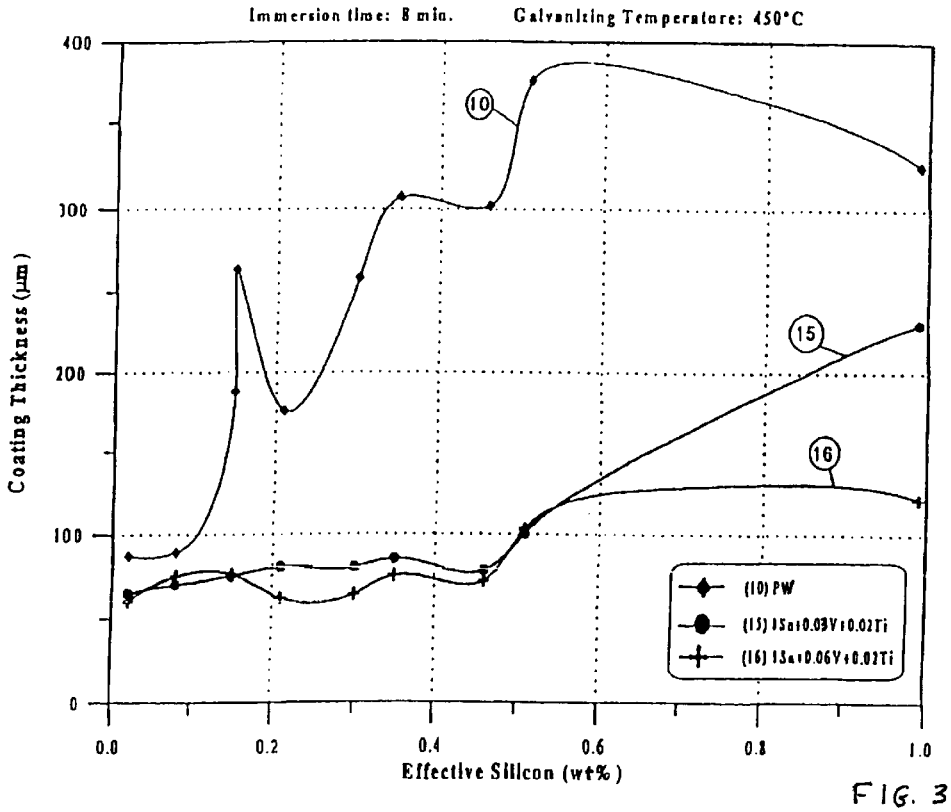

With reference to FIGS. 1–3, curve 10 typifies the variation of thickness in microns on a steel surface of a coating of zinc of commercial purity, such as conventional Prime Western (PW), as a function of the silicon content of the steel. The term "commercial purity" used herein will be understood to include Prime Western, High Grade, and Special High Grade zinc. Under these conditions of bath temperature (450° C.) and immersion time (8 minutes), the thickness of zinc coating peaks at a thickness of about 260 microns at a silicon content of about 0.15 wt. %, decreases to a thickness of about 175 microns at a silicon content of about 0.2 wt. %, and then increases to a maximum thickness of about 375 microns at a silicon content of about 0.5 wt. %, decreasing in thickness slightly to a silicon content of 1.0 wt. %. This curve 10 will be recognized as being very similar to the well-known Sandelin Curve. The compositions of the steels used are listed in TABLE I below.

TABLE I

STEEL COMPOSITIONS: 1995 TRIALS

| Steel Alloy # | MTL Heat # | Chemical Composition (%) wt. Si | P | C | S | Mn | Al | Si Equivalent* |
|---|---|---|---|---|---|---|---|---|
| 1 | 95-18 | 0.021 | <0.006 | 0.11 | .0071 | 0.59 | 0.019 | 0.021 |
| | 95-20 | 0.019 | | 0.11 | .0051 | 0.76 | 0.035 | 0.019 |
| 2 | 95-4a | 0.15 | <0.006 | 0.10 | .0037 | 0.71 | 0.015 | 0.15 |
| | 95-4b | 0.15 | | 0.10 | .0026 | 0.70 | 0.016 | 0.15 |

TABLE I-continued

STEEL COMPOSITIONS: 1995 TRIALS

| Steel Alloy MTL # | Heat # | Chemical Composition (%) wt. Si | P | C | S | Mn | Al | Si Equivalent* |
|---|---|---|---|---|---|---|---|---|
| 3 | 95-4c | 0.21 | <0.006 | 0.10 | .0029 | 0.73 | 0.007 | 0.21 |
| | 95-4d | 0.21 | | 0.11 | .0038 | 0.73 | 0.005 | 0.21 |
| | 95-51 | 0.19 | | 0.13 | .0073 | 0.73 | 0.046 | 0.19 |
| 4 | 95-21a | 0.29 | <0.006 | 0.10 | .0030 | 0.70 | 0.035 | 0.29 |
| | 95-21b | 0.30 | | 0.10 | .0028 | 0.71 | 0.046 | 0.30 |
| 5 | 95-28 | 0.32 | <0.006 | 0.09 | .0069 | 0.76 | n.a. | 0.32 |
| | 95-42 | 0.36 | | 0.12 | .0067 | 0.83 | 0.032 | 0.36 |
| 6 | 95-21c | 0.46 | <0.006 | 0.10 | .0030 | 0.73 | 0.037 | 0.46 |
| | 95-21d | 0.46 | | 0.10 | .0029 | 0.73 | 0.036 | 0.46 |
| 7 | 95-22a | 0.51 | <0.006 | 0.09 | .0036 | 0.68 | 0.040 | 0.51 |
| | 95-22b | 0.51 | | 0.10 | .0032 | 0.68 | 0.042 | 0.51 |
| 8 | 95-22c | 0.99 | <0.006 | 0.09 | .0031 | 0.71 | 0.022 | 0.99 |
| | 95-22d | 0.98 | | 0.09 | .0031 | 0.71 | 0.022 | 0.98 |
| 9 | 95-23a | .019 | 0.02 | 0.09 | n.a. | 0.66 | 0.010 | 0.07 |
| | 95-23b | .018 | 0.02 | 0.09 | | 0.65 | 0.010 | 0.07 |
| 10 | 95-39 | .031 | 0.050 | 0.10 | .0071 | 0.80 | 0.036 | 0.16 |
| | 95-40 | .023 | 0.055 | 0.09 | .0072 | 0.71 | 0.047 | 0.16 |

Si equivalent = Si + 2.5 P
n.a. = not available

In accordance with ASTM Standards, e.g., the ASTM A-123 Standard (610 g/m$^2$ or 86 microns for 3.2 to 6.4 mm thick steel plate), a uniform coating thickness of about 100 microns is desired in order to meet minimum thickness requirements while avoiding the expense and waste of thick coatings. Also, excessive thickness of zinc coatings on reactive steels and steels of mixed reactivity due to high or variable silicon contents usually produce rough, porous, brittle, and generally unsightly coatings that can have poor adherence to the underlying steel surface.

It is generally accepted that the addition to the galvanizing bath of strong silicide formers may neutralize the influence of silicon in reactive steels. It has been found that vanadium alone is an effective alloying element for reducing the reactivity of silicon steels with up to 0.25 wt. % Si. Vanadium in the bath is believed to combine with the silicon to form vanadium suicides as inert particles that become dispersed in the zeta layer. The silicon-free iron can then react with zinc to form a very compact and smooth layer that prevents liquid bath metal from reaching the delta layer. In essence, the vanadium effectively suppresses reactivity by stabilizing the growth of the zeta layer in the coating, which controls the growth rate by a diffusion process.

It has been found that tin is also an effective element for reducing the reactivity of steels. Tests have shown that a galvanizing bath containing 2.5 wt. % to 5 wt. % tin can control reactivity in steels with up to 1 wt. % silicon content. However, tests have also shown that tin in amounts greater than 2 wt. % react rapidly with the galvanizing kettle wall steel at galvanizing temperatures. When the tin level in the galvanizing bath is below 2 wt. %, the reaction with the kettle steel proceeds at a slow rate, comparable to that of the commercial grade zinc. However, when the level of tin in a galvanizing bath is 2 wt. %, the presence of tin controls reactivity in steels with only up to 0.3 wt. % silicon.

The presence of at least 0.02 wt. % vanadium, preferably 0.05 wt. % to 0.12 wt. %, the solubility limit of vanadium, in combination with 0.5 wt. % to 2 wt. % tin, controls reactivity in steels having up to 1 wt. % silicon. Tests have shown that, in galvanizing baths containing 1 to 1.2 wt. % tin, 0.002 wt. % aluminum, and the balance zinc of commercial purity containing 0.8 wt. % lead, the presence of 0.05 wt. % to 0.08 wt. % vanadium effectively controls reactivity to varying degrees in steels having silicon contents up to 1 wt. %, as shown by the Sn—V curves 11 and 12 in FIG. 1.

Zinc of commercial purity, such as conventional Prime Western, contains up to 1.3 wt. % lead, typically about 0.8% lead. However, other available grades of zinc such as High Grade and Special High Grade have lower lead contents. There is a growing tendency to reduce and eliminate the presence of lead in galvanizing because of environmental, health and safety concerns. It has been observed that bare spots in galvanized coatings can be produced from galvanizing baths without lead or with reduced lead contents at lower levels of tin, about 1 wt. % tin with 0.05 wt. % vanadium and 0.002 wt. % aluminum, on steels having lower silicon contents.

It has been found that the addition of 0.05 wt. % to 0.5 wt. %, preferably 0.05 wt. % to 0.1 wt % bismuth, to Zn—Sn—V alloys containing 0.5 wt. % to 2 wt. % tin, 0.05 wt. % to 0.12 wt. % vanadium, 0.001 wt. % to 0.007 wt. % aluminum, the balance zinc, results in uniformly thick bright galvanized coatings having spangling and free of bare spots. The presence of bismuth is particularly beneficial for tin contents in the range of 1 wt. % to 1.5 wt. %.

In another embodiment of the process of the present invention, titanium is used in place of vanadium. The presence of at least 0.03 wt. % titanium, preferably 0.06 wt. % to 0.1 wt. %, in combination with 0.5 wt. % to 2.0 wt. % tin, controls reactivity in steels having up to about 0.5 wt. % silicon. Iin a galvanizing bath containing 1.9 wt. % tin, 0.002 wt. % aluminum, and the balance zinc of commercial purity, the presence of 0.06 wt. % to 0.10 wt. % titanium effectively controls reactivity to varying degrees in steels having silicon contents up to about 0.5 wt. %, as shown by Sn—Ti curve 13 in FIG. 2. Increasing the titanium content in the galvanizing bath to 0.1 wt. % does not increase the maximum silicon level controlled, as seen by Sn—Ti curve 14 in FIG. 2.

However, the addition of titanium to the bath forms a ternary Zn—Fe—Ti intermetallic that increases the amount of dross and ash during galvanizing and contributes to high rates of titanium consumption or depletion in the bath. It also adversely affects the appearance of the galvanized coating by eliminating the distinctive large spangle formed with the tin-vanadium alloy that most galvanizing customers favor.

Small amounts of titanium added to the tin-vanadium alloy as a substitute for a portion of the vanadium can be used to lower the level of vanadium in the alloy, without the adverse effects of the high titanium-tin alloy. The presence of at least 0.02 wt. % vanadium and at least 0.01 wt. % titanium, preferably 0.05 wt. % to 0.1 wt. % vanadium and titanium collectively, controls reactivity in steels having up to 1 wt. % silicon. In a galvanizing bath containing 1 wt. % tin, 0.002 wt. % aluminum, and the balance zinc of commercial purity, the presence of 0.06 wt. % vanadium and 0.02 wt. % titanium effectively controls reactivity in steels having silicon contents up to 1 wt %, as shown by Sn—V—

Ti curve 16 in FIG. 3. Reducing the vanadium content in the alloy may be desirable in some cases to offset the high cost of vanadium as compared to titanium.

Another embodiment of the alloy composition of the invention has utility in zinc-nickel alloy baths comprises aluminum in the amount of at least 0.001 wt. %, tin in the amount of about 0.5 wt. % to about 2 wt. %, and vanadium with nickel in the amount of at least 0.02 wt. % vanadium and at least 0.02 wt. %, preferably 0.05 wt. % to 0.1 wt. %, nickel, to a maximum of 0.15 wt. % vanadium and nickel collectively. The alloy compositions and the process of the invention will now be described with reference to the following illustrative examples.

EXAMPLE 1

Long Term Immersion Experiments of Kettle Steel in Zinc Alloy Baths to Determine Rate of Attack on the Steel and Maximum Allowable Limit for Tin in the Galvanizing Alloys Four alloys were prepared, and samples from kettle steel were immersed in each alloy for a period of about 11 days at a temperature of 480° C. This immersion temperature was about 30° C. higher than the normal galvanizing bath temperature to accelerate the reaction of the alloys with the kettle steel samples. All the baths were saturated with iron at the start of the experiments, and an addition of 0.004 wt. % aluminum was made. The baths were analyzed during the 11-day trial period, and additions were made as needed to maintain the nominal bath compositions. The four alloy compositions are listed in TABLE II below.

TABLE II

| Alloy | | Alloy Composition % wt | | | |
|---|---|---|---|---|---|
| No. | Designation | Sn | V | Ti | Ni |
| 1 | PW | — | — | — | — |
| 2 | Sn—Ni | 2.5 | — | — | 0.05 |
| 3 | V—Ti | — | 0.04 | 0.05 | — |
| 4 | Sn—V | 1.0 | 0.05 | — | — |

The composition of alloy No. 2 (Sn—Ni) is a high tin alloy. The composition of alloy No. 3 (V—Ti) is included in U.S. patent application Ser. No. 08/667,830. The composition of alloy No. 4 (Sn—V) is an embodiment of the alloy of the present invention.

Fifty-kg melts were prepared in a SiC crucible that was heated in a radiant tube furnace. Four steel samples measuring 32×51×25 mm were immersed in each alloy bath. Analysis of the kettle steel showed its composition to contain, by weight, 0.09 wt. % carbon, 0.02 wt. % silicon, 0.006 wt. % phosphorus, and 0.27 wt. % manganese. The samples were machined to remove surface scale, degreased with acetone, pickled in hydrochloric acid, weighed, measured, and pre-fluxed in $ZnNH_4Cl$ prior to immersion in the alloy baths.

The samples were removed after approximately 2, 4, 7 and 11 days immersion, and the coatings on the samples were removed by immersion first in hot sodium hydroxide solution and then in cold hydrochloric acid solution, and re-weighed. The differences in weight loss were divided by the initial surface areas of the samples to determine weight loss in grams/mm$^2$ of unit area. The results are shown in the graph of FIG. 4 as weight loss in g/mm$^2$ versus the immersion period in hours.

Figure 4:
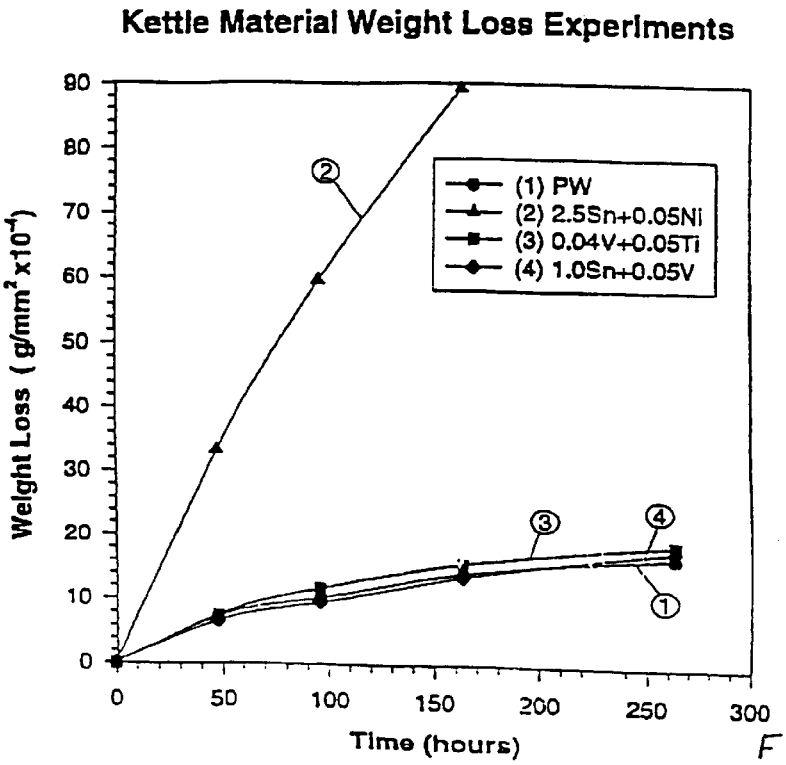
FIG. 4 is a graph illustrating kettle material weight losses for a variety of galvanizing alloys.

The curves in FIG. 4 show that the weight losses for alloy baths No. 3 (V—Ti curve) and No. 4 (Sn—V curve) are comparable to that observed for bath No. 1 (PW curve). The weight loss from alloy bath No 2 (Sn—Ni curve) after 150 hours is about six times as great as the others (Nos. 1, 3 and 4). More importantly, the slope of the No. 2 alloy curve is very steep, indicating that the reaction with the steel follows a rapid linear growth with immersion time that results in the formation of excessively thick coatings.

An additional PW melt was prepared and additions of tin were made at 0.2 wt. % increments, from 0.5 wt. % to 2.5 wt. % tin. Kettle steel samples were immersed at 480° C. and inspected after 24 hours and 48 hours. If no evidence of excessive coating growth was observed after 48 hours, the tin content in the bath was increased by 0.2 wt. %. When evidence of excessive growth was first observed, the tin content in the bath was reduced by 0.2 wt. %, and steel samples were immersed for a period of about two weeks to ensure that the coating growth rate was normal. From these experiments, it was determined that when the tin content in the bath exceeded 2 wt. %, the abnormal or excessive growth rate began to occur.

EXAMPLE 2

Galvanizing Trials

Ten alloys were prepared for laboratory-scale galvanizing trials. The alloying additions were made to PW grade zinc. The typical composition of PW zinc is shown in TABLE III below.

TABLE III

| COMPOSITIONS OF PW ZINC | | | |
|---|---|---|---|
| Element | PW (%) | Element | PW (%) |
| Pb | 0.80 | Cd | 0.0019 |
| Fe | 0.009 | Ca | 0.00005 |
| Al | 0.004 | Zr | — |
| Si | 0.0004 | Cu | 0.0032 |
| Mn | 0.007 | Mg | 0.00002 |
| Ni | 0.0005 | As | — |
| Cr | 0.001 | B | — |
| Ti | 0.0002 | Ga | 0.00005 |
| V | — | Ge | 0.0003 |
| Sn | 0.0001 | In | — |
| Sb | 0.0004 | Ti | 0.0002 |
| Bi | 0.002 | Zn | bal. |
| Ag | 0.0004 | — | — |

The experimental baths listed in TABLE IV below all were saturated with iron, and appropriate amounts of a 5 wt. % aluminum master alloy were added to maintain a 0.002 wt. % (brightener) aluminum level in the bath. The tin additions were made with high purity tin ingot, the vanadium additions with a Zn-2.3 wt. % V master alloy, and the titanium additions with a Zn-4 wt. % Ti master alloy.

TABLE IV

| BATH ALLOY COMPOSITIONS | | | | |
|---|---|---|---|---|
| | Bath | % Element | | |
| Trial No. | Designation | Sn | V | Ti |
| 1 | PW | — | — | — |
| 2 | PW + Sn | 1.8 | — | — |
| 3 | PW + Sn + V | 1.8 | 0.04 | — |
| 4 | PW + Sn + V | 0.4 | 0.12 | — |
| 5 | PW + Sn + V | 1.0 | 0.05 | — |
| 6 | PW + Sn + V | 1.2 | 0.08 | — |
| 7 | PW + Sn + Ti | 1.8 | — | 0.06 |
| 8 | PW + Sn + Ti | 1.8 | — | 0.10 |
| 9 | PW + Sn + V + Ti | 1.0 | 0.06 | 0.02 |
| 10 | PW + Sn + V + Ti | 1.0 | 0.03 | 0.02 |

Note: All baths saturated in iron and contain 0.002 wt % aluminum brightener.

A bench-scale line was set up to process the test samples consistently, using the following steps:

1. Degreasing: 0.25 g/cc NaOH solution at 70° C. with agitation for ten minutes
2. Rinse: tepid flowing water
3. Pickling: 15 wt. % HCl at room temperature, inhibited with Rodine™ 85 (1:4000), for 20 minutes
4. Pre-flux: 20 wt. % Zaclon™ K ($ZnNH_4Cl$) at 60° C., for two minute immersion.
5. Drying: oven-drying for five minutes at 110° C.

Twenty-five kg melts were prepared in a SiC crucible that provided a galvanizing surface 150 mm in diameter. The crucible was heated in a radiant tube furnace to provide a galvanizing temperature of 450±2° C. The melt surface was skimmed prior to immersion and just before the test coupons were withdrawn. The test coupons were dipped for eight-minute immersions at an immersion rate of 40 mm/sec and a withdrawal rate of 60 mm/sec. The samples were air-cooled at room temperature, without quenching.

Hot-rolled low-carbon silicon-killed steel coupons, measuring 77 mm×39 mm×3 mm, were used. The ten steel compositions, with silicon levels ranging from about 0.02 wt. % to 1 wt. %, are listed in TABLE 1, which includes the respective Si-equivalent or Si+2.5P level for the steels that takes into account the weighted effect of phosphorus as it relates to the reactivity behavior of the steel.

The galvanized coatings produced in the experiments were evaluated by the following methods:

Coating Appearance

The test coupons were photographed and classified under one of the three following categories: Normal, Reactive or Mixed. A description for each category of coating appearance is as follows:

| | |
|---|---|
| Normal: | The typical coating of a low-reactivity steel, usually bright and relatively smooth with visible spangle |
| Mixed: | The typical coating of a reactive steel, usually matte-grey with no visible spangle |
| Reactive: | The typical coating of a steel that has both reactive and non-reactive areas. The coating is usually very rough and varies from thin in low-reactivity areas to thick in the reactive areas |

Coating Thickness

Coating thickness measurements were made using an electromagnetic thickness gauge.

The coating thickness results are presented in graph form in FIGS. 1–3 and constitute the steel reactivity curves.

Metallography

Twenty-five-mm long pieces were cut from representative areas of the test coupons and prepared by conventional metallographic techniques for microscopic examination. All test samples were examined by optical microscopy. Selected samples were examined with a scanning electron microscope (SEM), and energy dispersive x-ray micro-analysis (EDS) was performed on selected. samples as required. From these galvanizing trials, the maximum effective steel silicon levels controlled by the various bath alloys were determined, the results being presented in TABLE V. As a reference. results of single element additions of tin, vanadium, titanium and nickel, obtained from past trials, are included in TABLE V.

TABLE V

| MAXIMUM EFFECTIVE SILICON (ESi) LEVEL IN STEEL CONTROLLED BY ALLOY ADDITION | | | | | |
|---|---|---|---|---|---|
| | Bath Alloy Addition (%) | | | | Maximum |
| PW Alloy | Sn | V | Ti | Ni | ESi % |
| Single | 1.8* | — | — | 0.09 | 0.20 |
| Element | — | 0.12 | — | — | 0.25 |
| Addition | — | — | 0.10 | — | 0.30 |
| Sn + Ti | 1.8[1] | 0.04 | — | — | 0.50 |
| Combination | 0.4[2] | 0.12 | — | — | 0.50 |
| | 1.0[3] | 0.05 | — | — | 0.50 |
| | 1.2[4] | 0.08 | — | — | 1.0 |
| Sn + Ti | 1.8 | — | 0.06 | — | 0.5 M |
| | 1.8 | — | 0.10 | — | 0.5 M |
| Sn + V + Ti | 1.0 | 0.06 | 0.02 | — | 1.0 |
| | 1.0 | 0.03 | 0.02 | — | 0.5 |

Notes:
[1]High Sn - Low V
[2]Low Sn - High V
[3]Preferred composition for 0.5% ESi
[4]Preferred composition for 1.0% ESi
M Marginal control with various amounts of mixed reactivity and heavier coatings than when fully controlled.

The results show that, as a single element addition, the maximum effective silicon level controlled is about 0.3 wt. %. When tin and vanadium are combined, 0.5 wt. % effective silicon can be controlled with a minimum level of 0.04 wt. % vanadium and a tin level of 1.8 wt. % (which is near the maximum allowable level), and with a minimum level of 0.4 wt. % tin and a 25 0.12 wt. % vanadium level. A preferred composition for controlling the 0.5 wt. % Si level is 1.0 wt. % tin with 0.05 wt. % vanadium. The 1.0 wt. % effective silicon can be controlled with a preferred composition of 1.2 wt. % tin and 0.08 wt. % vanadium.

When tin is combined with titanium, the maximum effective silicon level that was controlled was 0.5 wt. %. even when the maximum allowable amount of 1.8 wt. % tin and an amount of 0.1 wt. % titanium were added to the galvanizing bath.

When vanadium and titanium are added together, it is possible to control the 0.5 wt. % effective silicon with additions of 1.0 wt. % tin, 0.03 wt. % vanadium, and 0.02 wt. % titanium, and the 1 wt. % effective silicon level with additions of 1.0 wt. % tin, 0.06 wt. % vanadium, and 0.02 wt. % titanium. The addition of titanium to the tin and vanadium alloy allows for a reduction in the amount of vanadium needed to control at both the 0.5 wt. % and 1.0 wt. % effective silicon levels.

EXAMPLE 3

Addition of Bismuth

Trials were conducted on 77 mm×39 mm×3 mm low silicon steel coupons that were pretreated by an acetone rinse and scrubbing, pickling in 15% HCl solution for 10–15 minutes, preflux of ZACLON K™ (20° Be) for 2 minutes at 70° C., and oven-dried at 100° C. for 5 minutes.

The coupons were galvanized by immersion for 4 minutes in zinc alloy baths of Special High Grade 25-kg melt saturated with iron and containing 0.004 wt. % aluminum, 1 wt. % tin, 0.05 wt. % vanadium, and varying amounts of bismuth at a temperature of 450° C.

The test results are shown in TABLE VI.

TABLE VI

BATH ALLOY COMPOSITIONS-SHG + Sn + V + Bi

| | % Element | | | |
|---|---|---|---|---|
| Trial No. | Sn | V | Bi | Observations |
| 1 | 1.0 | 0.05 | | Severe bare spots and small spangling |
| 2 | 1.0 | 0.05 | 0.05 | Substantially complete elimination of bare spots, and larger spangling |
| 3 | 1.0 | 0.05 | 0.1 | Free of bare spots and larger spangles |
| 4 | 1.0 | 0.05 | 0.2 | Free of bare spots and very larger spangles |
| 5 | 1.0 | 0.05 | 0.5 | Free of bare spots and very larger spangles |

Note: all baths contain 0.004 wt. % aluminum brightener

Note: all baths contain 0.004 wt. % aluminum brightener

The presence at least 0.05 wt. % bismuth was found to be effective in obviating bare spots and in enhancing spangling of the galvanized coating. An upper limit of bismuth of 0.1 wt. % bismuth was found economically viable; amounts in excess of 0.1% up to 0.5% did not improve the quality of coating.

The invention provides several important advantages. Galvanized coatings produced in accordance with the invention are complete and uniform and of desired thickness on low and high silicon steels, including steel having silicon contents from 0.01 wt. % to at least 0.5 wt. %. The coatings produced also have a bright metallic luster. The process can be easily adapted to conventional galvanizing production equipment using normal galvanizing temperatures and immersion times.

It will be understood, of course, that modifications can be made in the embodiment of the invention illustrated and described herein without departing from the scope and purview of the invention, as defined by the following claims.

What is claimed is:

1. An alloy for galvanizing steel consisting essentially of, by weight, aluminum in the amount of 0.001% to 0.007%, tin in the amount of 0.5% to 2%, and one of an element selected from the group consisting of vanadium in the amount of 0.02% to 0.12%, titanium in the amount of 0.03% to 0.10%, and both vanadium and titanium together in the amount of at least 0.02% vanadium and at least 0.01% titanium for a total of 0.03% to 0.15% vanadium and titanium collectively, and optionally bismuth in the amount of 0.05% to 0.5%, the balance zinc of commercial purity containing up to 1.3 wt. % lead.

2. An alloy as claimed in claim 1 further containing, by weight, vanadium in the amount of 0.05% to 0.12%.

3. An alloy as claimed in claim 1 further containing, by weight, titanium in the amount of 0.06% to 0.10%.

4. An alloy as claimed in claim 1, in which the zinc alloy contains, by weight, at least 0.03% vanadium and titanium when vanadium and titanium are present together, said vanadium being present in the amount of at least 0.02% and said titanium being present in the amount of at least 0.01%, to a maximum of 0.15% vanadium and titanium collectively.

5. An alloy as claimed in claim 4 in which the vanadium and titanium are present together, by weight, in the amount of at least 0.05%.

6. An alloy for galvanizing steel consisting essentially of, by weight, aluminum in the amount of 0.001% to 0.007%, tin in the amount of 0. 5% to 2%, vanadium in the amount of 0.02% to 0.12%, and optionally bismuth in the amount of 0.05% to 0.5%, the balance zinc of commercial purity containing up to 1.3 wt. % lead.

7. An alloy as claimed in claim 6 further containing, by weight, bismuth in the amount of 0.05% to 0.1%.

8. An alloy for galvanizing steel consisting essentially of, by weight, aluminum in the amount of 0.001% to 0.007%, tin in the amount of 0.5% to 2.0%, and vanadium and nickel in the amount of at least 0.02% vanadium and at least 0.02% nickel to a maximum of 0.15% vanadium and nickel collectively, the balance zinc of commercial purity containing up to 1.3 wt. % lead.

9. An alloy for galvanizing steel consisting essentially of, by weight, aluminum in the amount of 0.001% to 0.007%, tin in the amount of 0.5% to 2.0%, vanadium in the amount of 0.02% to 0.12%, and bismuth in the amount of 0.05% to 0.5%, the balance zinc of commercial purity containing up to 1.3 wt. % lead.

10. A process for galvanizing steel by immersion in a zinc alloy galvanizing bath comprising:

immersing the steel in a molten bath of a zinc alloy consisting essentially of, by weight, 0.001% to 0.007% aluminum, 0.5% to 2% tin, and an amount effective for reducing reactivity of the steel of at least one element selected from the group consisting of 0.02% to 0.12% vanadium, 0.03% to 0.10% titanium, and at least 0.02% vanadium and at least 0.01% titanium for a total of 0.03% to 0.15% vanadium and titanium collectively, and optionally 0.05% to 0.5% bismuth, the balance zinc of commercial purity containing up to 1.3 wt. % lead.

11. A process as claimed in claim 10, in which the zinc alloy contains, by weight, at least 0.05% vanadium.

12. A process as claimed in claim 11, in which the zinc alloy contains, by weight, 0.05% to 0.12% vanadium.

13. A process as claimed in claim 10, in which the zinc alloy contains, by weight, at least 0.06% titanium.

14. A process as claimed in claim 13, in which the zinc alloy contains, by weight, 0.06% to 0.10% titanium.

15. A process for galvanizing steel by immersion in a zinc alloy galvanizing bath comprising:

immersing the steel in a molten bath of a zinc alloy consisting essentially of, by weight, 0.001% to 0.007% aluminum, 0.5% to 2% tin, and vanadium and nickel in the amount of at least 0.02% vanadium and at least 0.02% nickel to a maximum of 0.15% vanadium and nickel collectively, and optionally 0.05% to 0.5% bismuth, the balance zinc of commercial purity containing up to 1.3 wt. % lead.

16. A process for galvanizing steel by immersion in a zinc alloy galvanizing bath comprising:

immersing the steel in a molten bath of a zinc alloy consisting essentially of, by weight, 0.001% to 0.007% aluminum, 0.5% to 2% tin; and vanadium, nickel, and titanium in the amount of at least 0.02% vanadium, at least 0.02% nickel, and at least 0.01% titanium to a maximum of 0.2% vanadium, nickel, and titanium collectively, and optionally 0.05% to 0.5% bismuth, the balance zinc of commercial purity containing up to 1.3 wt. % lead.

17. A process for galvanizing steel by immersion in a zinc alloy galvanizing bath comprising:

immersing the steel in a molten bath of zinc alloy consisting essentially of, by weight, 0.001% to 0.007% aluminum, 0.5% to 2.0% tin, 0.02% to 0.12% vanadium, and 0.05% to 0.5% bismuth, the balance zinc of commercial purity containing up to 1.3 wt. % lead.

18. A process as claimed in claim 17, in which the molten zinc bath further contains, by weight, 0.05% to 0.1% bismuth.

* * * * *

UNITED STATES PATENT AND TRADEMARK OFFICE

CERTIFICATE OF CORRECTION

PATENT NO. : 6,280,795 B1 
DATED : August 28, 2001
INVENTOR(S) : John Zervoudis et al.

It is certified that error appears in the above-identified patent and that said Letters Patent is hereby corrected as shown below:

Title page,
Item [73], Assignee, please add the following as the second Assignee:
-- N.V. Union Miniere S.A., Rue du Marais 31, B-1000, Brussels, [BE] --.

Signed and Sealed this

Twenty-fifth Day of March, 2003

JAMES E. ROGAN
*Director of the United States Patent and Trademark Office*